United States Patent [19]

Black

[11] Patent Number: 4,694,532

[45] Date of Patent: Sep. 22, 1987

[54] ROD SUPPORT SYSTEM HAVING END BRACKETS AND AUXILIARY SUPPORT BRACKETS

[76] Inventor: Alee R. Black, 403 N. 24th St., East St. Louis, Ill. 62205

[21] Appl. No.: 792,217

[22] Filed: Oct. 28, 1985

[51] Int. Cl.[4] ..... A47H 1/142

[52] U.S. Cl. ..... 16/94 D; 160/123; 248/263

[58] Field of Search ..... 16/94 D, 95 D, 93 D, 16/96 D, 94 R, 87.4 R, 87.2; 248/261, 263, 265, 223.4, 253, 255; 160/123, 126

[56] References Cited

U.S. PATENT DOCUMENTS

| | | | |
|---|---|---|---|
| 1,375,805 | 4/1921 | Umphrey | 248/263 |
| 1,591,209 | 6/1926 | Boye | 16/96 D |
| 1,720,308 | 7/1929 | Vogt | 248/263 |
| 1,790,258 | 1/1931 | Boye | 248/265 |
| 2,720,373 | 10/1955 | Bell | 16/94 D |
| 2,985,907 | 5/1961 | Duncan | 16/94 D |

FOREIGN PATENT DOCUMENTS

| | | | |
|---|---|---|---|
| 412233 | 11/1966 | Switzerland | 248/263 |
| 1026728 | 4/1966 | United Kingdom | 16/87.4 R |

*Primary Examiner*—Fred Silverberg
*Attorney, Agent, or Firm*—Edward R. Weber

[57] ABSTRACT

The present invention relates to an improvement in the supports for draperies, curtains, and the like, and more particularly, to improvments in the supports for coverings of bay windows wherein multiple treatments of the bay window can be achieved by a compact unit which is capable of being installed easily and which can adjust to the particular requirements of the windows and do so in a manner which will not detract from the various treatments, and which is inexpensive in construction.

4 Claims, 6 Drawing Figures

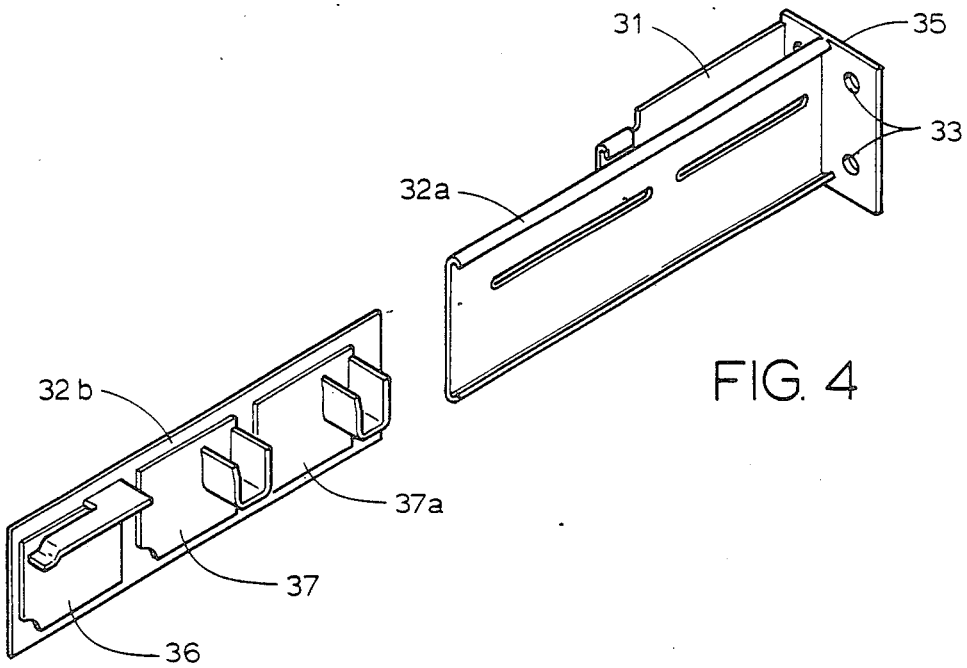
FIG. 4
FIG. 5
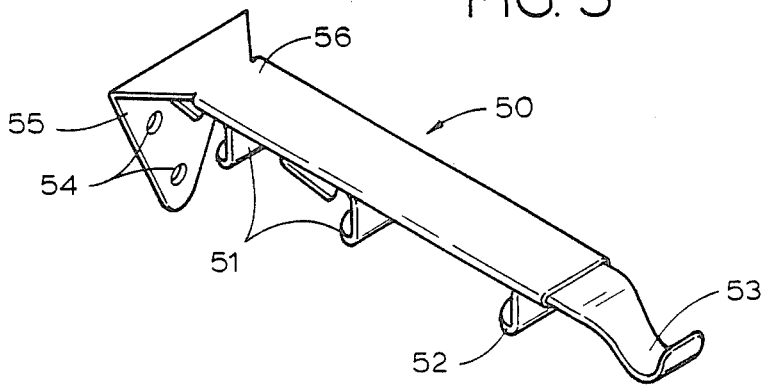
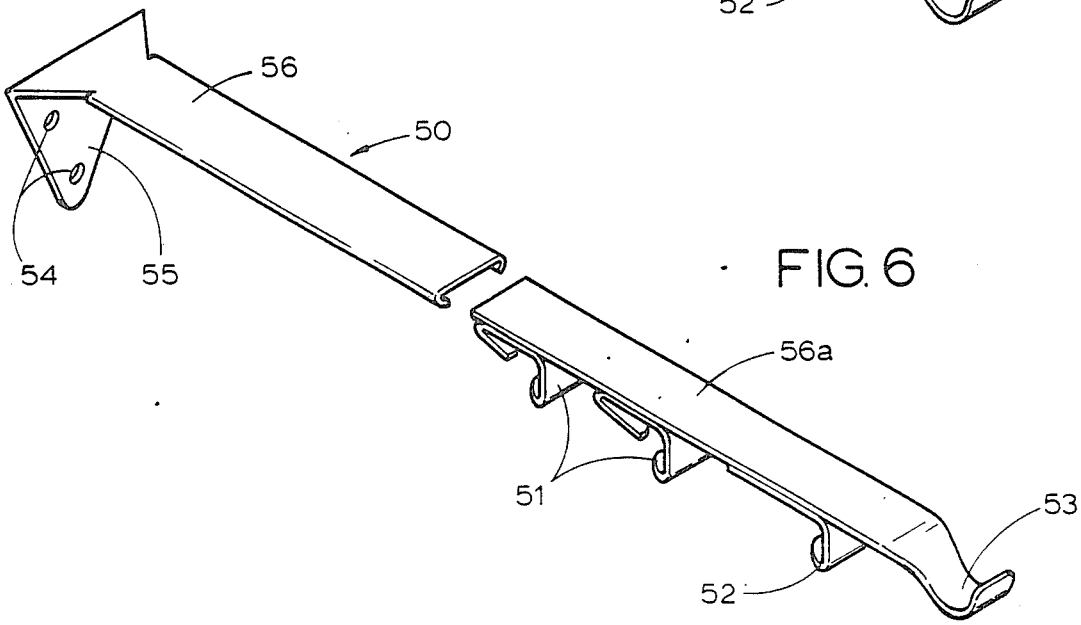
FIG. 6

ROD SUPPORT SYSTEM HAVING END BRACKETS AND AUXILIARY SUPPORT BRACKETS

FIELD OF THE INVENTION

The present invention relates to an improvement in the supports for draperies, curtains, and the like, and more particularly, to improvements in the supports for coverings for bay windows wherein multiple treatments of the bay window can be accomplished by a unit which is compact, is easily installed, can be easily and inexpensively constructed, can be easily adjusted to meet the particular requirements of bay windows, and which can do so in a manner which will not detract from the various treatments.

BACKGROUND OF THE INVENTION

Bay windows are regarded by many as one of the most beautiful features of a home. However, covering those windows with draperies, curtains, and the like has been a nightmare for both the interior decorator and the homeowner. In order to achieve certain, varied effects, a person may wish to have a curtain which will allow diffused light to enter the home, or a curtain which will provide a screen, or a drapery which will provide complete privacy, and a covering which will provide an attractive treatment for an otherwise unsightly curtain rod, or any combination thereof. To accomplish any of the singular or combined effects desired has required multiple curtain rods, which are unattractive, cumbersome to handle, inconvenient to locate, and generally undesirable.

The present invention addresses these problems in that it allows for two curtain rods, one drapery or traverse rod, and one valance rod to be combined in a single unit which is easily affixed to a stationary wall or window frame, the unit of the present invention thereby being convenient to locate, easy to use, attractive, and able to achieve any number of varied window treatments.

SUMMARY OF THE INVENTION

The present invention provides an attractive and reliable means for supporting multiple curtain and drapery treatments from a bay window frame or wall surrounding the window in a manner which allows for easy installation on the wall, which will not injure or detract from the curtains or draperies, which can be adjusted to conform to various window widths, and which is inexpensively constructed. The device of the present invention is a combination rod comprised of two end brackets, multiple straight curtain rods, multiple elbowed curtain rods, multiple straight traverse rods, multiple elbowed traverse rods, multiple straight valance rods, multiple elbowed valance rods, multiple curved valance rods, and auxiliary support brackets as needed. A preferred embodiment of the combination rod is manufactured of materials known to the art, utilizing a two way draw cord traverse assembly, but the unit could be easily adapted for single draw, etc.

In use the end brackets are formed such that a valance rod support segment and a mated two-piece rod support segment extend from a back plate which is affixed to the wall or bay window frame by conventional means, such as screws, toggle bolts, moly bolts, etc. Each mated two-piece rod support segment is comprised of a support arm and a triple projection extender fitted with three rod sockets which will allow a person to utilize a combination of curtain rods and traverse rods to achieve a specific desired effect. The valance rod support segment can be formed such that it can accept a number of different types of valance rods, which may or may not extend around the end of the mated two-piece rod support segment depending upon the window treatment desired. The unique and most desirable feature of the present invention is that the mated two-piece rod support segment and auxiliary support brackets have components which will allow the various parts to be removed from the back plate conveniently. In this way the combination rod can be pre-assembled and then mated with the support arm previously affixed to the wall, thereby making the installation of the rod a one-step operation.

Attached to the rod sockets of the triple projection extender of the mated two-piece rod support segment of a first end bracket, in a particular embodiment, are a length of straight traverse rod in the rod socket farthest from the bay window. The straight traverse rod length is then telescopically inserted into an elbowed section of traverse rod, such that the rod runs parallel to the wall and conforms to the corner of the bay window. The elbowed section of the traverse rod then telescopically receives a straight length of traverse rod, which will continue to run parallel to the window or wall. This straight length of traverse rod is then telescopically inserted into an elbowed section of traverse rod, such that the unit continues to run parallel to the wall and conforms to the window corner. This second elbowed traverse rod then telescopically receives a straight length of traverse rod, the unit continuing to run parallel to the wall, which then fits into the traverse rod socket of the triple projection extender of the mated two-piece rod support segment of a second end bracket. The traverse rod, in a particular embodiment, encloses a conventional two way cord draw wherein the master slides meet in the center of the second length of straight traverse rod and the cord length is continuous, moving through a tension pulley affixed to the wall or floor such that the cord runs perpendicular to said end bracket.

In the remaining rod sockets of the triple projection extender of the mated two-piece rod support segment of the first end bracket, each will receive one end of a straight length of curtain rod, the other end of said rod being telescopically inserted into an elbowed section of curtain rod, such that both curtain rods will run parallel to the wall or window frame and the traverse rod and will conform to the window corner. The elbowed section of each curtain rod then telescopically receives a second straight length of curtain rod, such that the unit continues to run parallel to the wall or window frame and the traverse rod. Each straight length of curtain rod is then telescopically inserted into an elbowed section of curtain rod, such that the curtain rods continue to run parallel to the wall or window frame and the traverse rod and conform to the window corner. Finally each elbowed length of curtain rod receives a straight length of curtain rod, the free ends of the straight lengths then being inserted into rod sockets of the triple projection extender of the mated two-piece rod support segment of the second end bracket, such that the curtain rods continue to run parallel to the wall or window frame, the traverse rod, and each other.

The valance rod support segment of the first end bracket in a particular embodiment receives the end of a curved valance rod in slidable engagement such that the valance rod will follow around the mated two-piece rod support segment in spaced relation thereto allowing a valance to surround and mask the various parts of the present invention, thus giving a complete, attractive finish to the window treatment. The free end of the curved valance rod is then telescopically inserted into an elbowed section of valance rod such that the valance rod will run parallel to the wall or window frame and the various parts of the present invention and conform to the window corner. This elbowed section telescopically receives a straight length of valance rod which allows the valance rod to continue to run parallel to the wall or window and the various parts of the invention. This straight length of valance rod is then telescopically inserted into an elbowed section of valance rod, such that the valance rod follows the window corner running parallel to the wall or window frame and the various parts of the present invention. The elbowed section of valance rod then telescopically receives a curved section of valance rod, such that the curved section runs parallel to the wall or window frame and the various parts of the present invention past the mated two-piece rod support segment and curves to meet in slidable engagement with the valance rod support segment of the second end bracket in such manner that spaced relation is maintained between the valance rod and the valance rod support segment unit and the mated two-piece rod support segment of the second end bracket and the various parts of the present invention.

Given the weight of various window treatments and the size of many bay windows, the present invention utilizes a number of auxiliary support brackets. Each auxiliary support bracket is formed of a wall mounted segment and a mating rod support segment. Similar to the mechanism of the end bracket, the mating rod support segment can be removed from the wall mounted segment which, in use, is slidably engaged. This facilitates the simple one-step installation of the combination rod as a singular unit. A universal stirrup for each curtain rod and traverse rod is attached to the mating rod support segment which has a shaped valance rod support stirrup at its end. The back plate of the wall mounted segment is affixed to the wall or window frame by conventional means, such as screws, toggle bolts, moly bolts, etc. Any number of auxiliary support brackets can be used with the combination rod to give adequate support to the unit and the various window treatments. In a preferred embodiment, an auxiliary support bracket would be used for each straight length of wall or window frame to which the combination rod conforms.

In use the device of the present invention allows a person to install easily a combination rod to cover a bay window with a variety of window treatments which can include a combination of sheers to allow diffused light to enter with a drapery which could be closed to provide complete privacy when desired and a valance to present an attractive covering for the combined effect; or priscillas to allow diffused and direct light to enter with a drapery which could provide complete privacy when desired and a valance; or a sheer for diffused lighting with a voile for heavier covering when desired but not complete privacy and a valance to match, and so forth. Thus the many advantages of the invention are realized and other advantageous results are attained. The traverse rod for bay window provides for multiple, attractive, window treatments for a variety of effects in a manner that is easy to install and use, that is easily adjustable to the individual particularities of the bay window, and that is inexpensively constructed.

BRIEF DESCRIPTION OF THE DRAWINGS

FIG. 4 is a perspective view of the end bracket as seen in FIG. 3. showing the mated two-piece rod support segment unassembled.

FIG. 5 is a perspective view of the assembled auxiliary support bracket showing two curtain rod stirrups, a traverse rod stirrup, and a valance stirrup extending from the underside.

FIG. 6 is a perspective view of the auxiliary support bracket unassembled showing two curtain rod stirrups and a traverse rod stirrup affixed to the mating rod support segment which ends with a shaped valance stirrup.

DETAILED DESCRIPTION OF THE DRAWINGS

Figure 1:
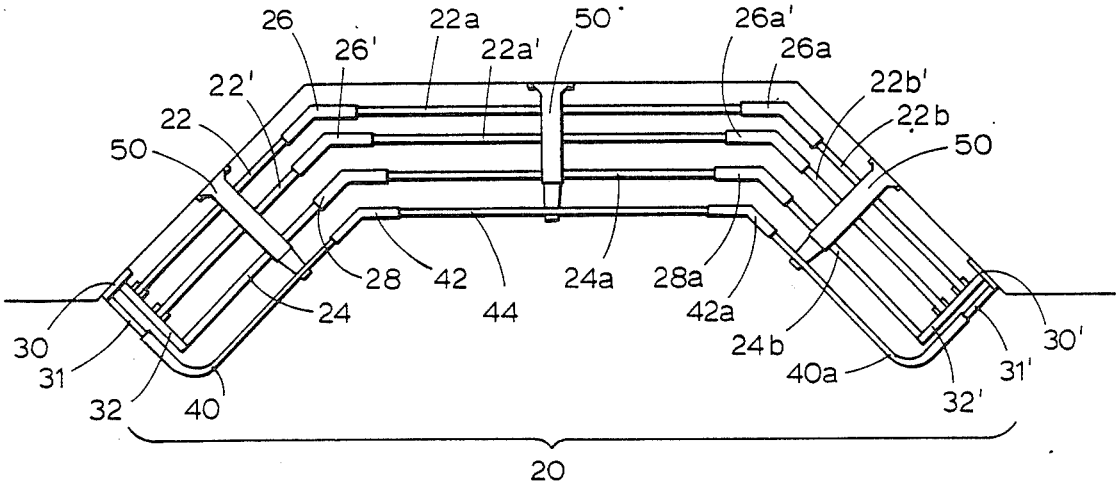
FIG. 1 is a top view of the combination rod as assembled.

Referring now to the drawings wherein like reference characters represent like elements, FIG. 1 shows the combination rod 20 of the present invention as assembled from an elevated view. The assembled device 20 shows the end brackets 30 and 30' as they would be seen affixed to the wall or window frame such that the rod sockets face each other to accept the various rod pieces between them. In the rod socket closest to the wall as seen on the mated two-piece rod support segment 32 of end bracket 30, one end of a section of straight curtain rod 22 is inserted into the curtain rod socket, the free end being telescopically inserted into an elbowed section of curtain rod 26 allowing the rod unit to conform to the window corner. Elbowed section 26 telescopically receives a straight length of curtain rod **22*a* allowing the unit to continue to conform to the specifications of the window. The free end of straight section curtain rod 22*a* is then telescopically inserted into an elbowed section of curtain rod 26*a*, allowing the rod unit to conform to the window corner. Elbowed section curtain rod 26*a* then receives a straight length of curtain rod 22*b*, the free end of curtain rod 22*b* being inserted into the rod socket closest to the wall in the mated two-piece rod support segment 32' of end bracket 30'**.

In the middle rod socket, as seen on the mated two-piece rod support segment 32 of end bracket 30 is inserted one end of a straight length of curtain rod 22', the free end of rod 22' being telescopically inserted into an elbowed section of curtain rod 26' allowing the rod to conform to the window corner in spaced relationship to the wall and curtain rod units 22–26. Elbowed section 26' receives a straight length of curtain rod **22*a'* which is telescopically inserted into curtain rod 26'. The free end of straight curtain rod 22*a'* is telescopically inserted into an elbowed section of curtain rod 26*a'*, which allows the rod to conform to the window corner while maintaining a spaced relationship with the wall and curtain rod units 22a–26a. Elbowed section 26a' then telescopically receives a straight length of curtain rod 22b', the free end of curtain rod 22b' being inserted into the middle rod socket of the mated two-piece rod support segment 32' of end bracket 31', thus maintaining the spaced relationship between curtain rod unit 22'–26'–22a'–26a'–22b', curtain rod unit 22–26–22a–26a–22b**, and the wall or window frame.

In the traverse rod socket as seen on the mated two-piece rod support segment 32 of end bracket 30 farthest from the wall is clamped a straight length of traverse rod with a left side end fixture 24, the free end of straight traverse rod 24 being telescopically inserted into an elbowed section of traverse rod 28 allowing the rod to conform to the specifications of the window corner in spaced relationship to curtain rod units 22–26 and 22'–26' and the wall. Elbowed traverse rod 28 receives a straight length of traverse rod 24a which is telescopically inserted into elbowed traverse rod 28. The free end of straight traverse rod 24a is telescopically inserted into an elbowed section of traverse rod 28a, allowing the traverse rod unit to conform to the window corner while maintaining spaced relationship to the wall and curtain rod units 22a–26a and 22a'–26a'. Elbowed section 28a receives telescopically a straight length of traverse rod with a right side end fixture 24b, the right side end fixture of rod 24b being clamped into the traverse rod socket of the mated two-piece rod support segment 32' of end bracket 30', thus maintaining the spaced relationship between traverse rod unit 24–28–24a–28a–24b and curtain rod unit 22'–26'–22a'–26a'–22b', curtain rod unit 22–26–22a–26a–22b, and the wall or window frame.

The valance rod support segment 31 of end bracket 30 receives a curved end section of valance rod 40 which has been slidably engaged allowing valance rod 40 to curve around the end of mated two-piece rod support segment 32 in spaced relationship thereto, the free end of valance rod 40 being telescopically inserted into an elbowed section of valance rod 42 allowing the valance rod unit to conform to the window corner while maintaining spaced relationship with the wall or window frame, curtain rod units 22–26 and 22'–26', and traverse rod unit 24–28. Elbowed section 42 then telescopically receives a straight length of valance rod 44 allowing the valance unit to conform to the particularities of the window. The free end of straight valance rod 44 is telescopically inserted into an elbowed section of valance rod 42a, allowing the valance rod unit to conform to the window corner. The elbowed section 42a then telescopically receives the straight end of curved valance rod 40a, the curved end recurving in spaced relationship around mated two-piece rod support segment 32' and in slidable engagement with valance rod support segment 31' of end bracket 30'.

To help maintain the spaced relationships between the wall or window frame and the various parts of combination rod 20, a auxiliary support bracket 50 is affixed to the wall or window frame. In a preferred embodiment, there would be one auxiliary support bracket for each straight length of wall or window frame to which the combination rod conforms.

Figure 2:
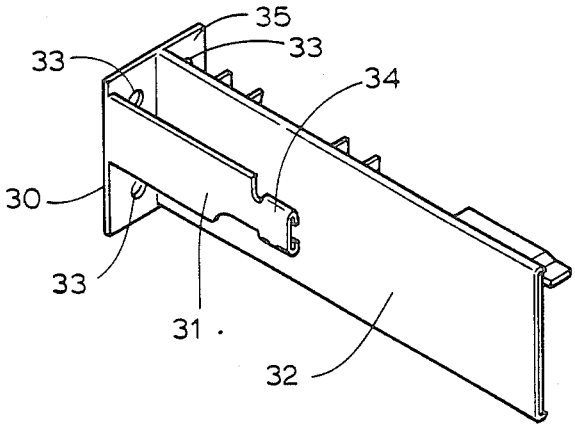
FIG. 2 is a perspective view of an assembled end bracket including the mated, two-piece rod support segment and valance rod support segment.

FIG. 2 is a side view of end bracket 30 illustrating valance rod support segment 31 and assembled mated two-piece support segment 32 extending perpendicularly from back plate 35 and running parallel to each other. Back plate 35 will be seen to have holes 33 at various locations through which screws may be inserted to affix the end bracket to the wall or window frame. Valance rod support segment 31 will be seen to have a smaller shaped end 34, which accepts and locks into place a curved valance rod which is shaped to slidably engage the valance bracket.

Figure 3:
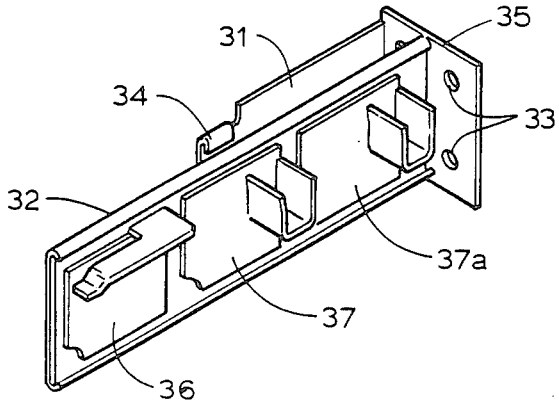
FIG. 3 is a perspective view of an assembled end bracket showing the mated two-piece rod support segment with a traverse rod socket and two curtain rod sockets and the valance rod segment, partly obscured.

FIG. 3 is a side view of the unseen side of the assembled mated two-piece rod support segment 32 as viewed in FIG. 2. The assembled mated two-piece support segment 32 will be seen to have three rod sockets in spaced relationship along the length of the segment. Farthest from back plate 35 in the assembled state is traverse rod socket 36 in a preferred embodiment. Curtain rod sockets 37 and 37a will be seen in the middle and nearest positions to back plate 35 in the assembled state in a preferred embodiment.

FIG. 4 is a side view of mated two-piece rod support segment 32 as viewed in FIG. 3 showing the segment unassembled. As will be seen, the support arm 32a of the mated two-piece rod support segment 32 extends perpendicularly from back plate 35 and has rounded edges to accept and hold in slidable engagement triple projection extender 32b. *Triple projection extender 32b* will be seen to have attached thereto three rod sockets in spaced relationship along its length. Farthest from back plate 35, when assembled, is traverse rod socket 36 in a preferred embodiment. Curtain rod sockets 37 and 37a will be seen in the middle and nearest positions to back plate 35, when assembled, in a preferred embodiment. In use, a traverse rod assembly and two curtain rod assemblies are clamped and inserted, respectively, into the particular rod sockets and the triple projection extender 32b is slid into support arm 32a.

FIG. 5 is a side view of assembled auxiliary support bracket 50. The support arm 56 of auxiliary support bracket 50 is seen to extend perpendicularly from back plate 55, in which holes 54 are located to accept screws by which the auxiliary support bracket 50 may be affixed to the wall or window frame. Shaped valance rod stirrup 53 is seen to extend beyond the end of support arm 56 of auxiliary support bracket 50. Two curtain rod stirrups 51 and a traverse rod stirrup 52 are seen to extend below support arm 56 of auxiliary support bracket 50.

FIG. 6 is a side view of the auxiliary support bracket 50 in its unassembled state. As will be seen, support arm 56 of auxiliary support bracket 50 extends perpendicularly from back plate 55 and has rounded edges to accept and hold in slidable engagement mating rod support segment 56a which ends in a shaped valance rod support stirrup 53. In keeping with our preferred embodiment, the traverse rod stirrup 52, being in spaced relationship with two curtain rod stirrups 51, is farthest from back plate 55 when auxiliary support bracket 50 is in its assembled state. Curtain rod stirrups 51, being in spaced relationship with each other and traverse rod stirrup 52, are seen in the middle and closest positions to back plate 55 when auxiliary support bracket 50 is in its assembled state. In use, a traverse rod assembly and curtain rod assemblies are hooked into the traverse rod stirrup and curtain rod stirrups, respectively, and a valance rod is supported by the valance rod support stirrup; the mating rod support segment 56a is then inserted into support arm 56 of auxiliary support bracket 50.

Thus it is seen that a desired arrangement of traverse, curtain, and valance rods can be pre-assembled using the triple projection extender portion of the end brackets and the mating rod support segment of the auxiliary support brackets. The completed assembly can then be easily mounted onto the wall by engaging the triple projection extenders and mating rod support segments with the previously mounted wall brackets.

Although the present invention has been described and illustrated with respect to a preferred embodiment thereof, it is to be understood that it is not to be so limited since changes and modifications may be made therein which are within the full intended scope of this invention as hereinafter claimed.

What is claimed is:

1. A combination drapery, curtain and, valance suspension system consisting of two end brackets each having a wall mounted segment, a valance rod support segment, and a slidably mated two-piece rod support segment comprised of a support arm and an extender arm which has a plurality of rod support sockets affixed thereto, wherein said valence rod support segment and said slidably mated two-piece rod support segment extend outwardly from said wall mounted segment, a traverse rod assembly consisting of a plurality of straight and elbowed traverse rods mounted in a corresponding number of said rod support sockets, a plurality of curtain rod assemblies consisting of a plurality of straight and elbowed curtain rods mounted in the remaining rod support sockets, a valance rod assembly consisting of a plurality of curved, elbowed, and straight valance rods mounted on said valance rod support segment, and a plurality of two-piece slidably mated auxiliary support brackets each having a wall mounted segment and a mating rod support segment having a plurality of rod support stirrups on a bottom side thereof and a valence rod support stirrup on a top side thereof, said auxiliary support brackets positioned at intermediate points and supporting said traverse, curtain, and valance rods at said intermediate points.

2. An end bracket for a drapery, curtain, and valance suspension system comprised of a wall mounted segment, a valance rod support segment, and a mated two-piece rod support segment consisting of a support arm and an extender arm; said wall mounted segment having a back plate containing a plurality of holes for securing said end bracket to a mounting surface; said back plate having said valance rod support segment and said support arm of said mated two-piece rod support segment extending substantially perpendicularly therefrom and substantially parallel to each other; said valance rod support segment having a curved end piece sized to mate with a valance rod near the free end of said valance rod so as to positively support said free end of said valance rod in slidable engagement; said support arm being sized and shaped to slidably engage said extender arm; said extender arm being sized to correspond with said support arm of said mated two-piece rod support segment when in slidable engagement and having a traverse rod socket and two curtain rod sockets in spaced relation along the length thereof; said traverse rod socket located at the end of said extender arm farthest from said back plate; said curtain rod sockets being located at spaced intermediate locations on said extender arm.

3. An auxiliary support bracket for a drapery, curtain, and valance suspension system comprised of a wall mounted segment and a mating rod support segment; said wall mounted segment having a back plate containing a plurality of holes therein to affix said auxiliary support bracket to a mounting surface and a support arm extending substantially perpendicularly from said back plate sized and shaped to slidably engage and support said mating rod support segment of said auxiliary support bracket; said mating rod support segment on its top side having a shaped valance rod support stirrup at its end, and on its bottom side having a traverse rod support stirrup and two curtain rod support stirrups spaced at intermediate points along said rod support segment.

4. A combination drapery, curtain, and valance suspension system comprising a first end bracket consisting of a wall mounted segment, a valance rod support segment, and a slidably mated two-piece rod support segment consisting of a support arm and an extender arm, said extender arm having a plurality of rod support sockets; wherein said valence rod support segment and said slidably mated two-piece rod support segment extend outwardly from the wall mounted segment, a traverse rod assembly with a left side end fixture inserted into the rod support socket located farthest from the wall on said first end bracket, the free end of said straight length of said traverse rod being telescopically inserted into an elbowed section of traverse rod, said elbowed traverse rod accepting telescopically in its free end a straight length of traverse rod, the free end of said straight length of traverse rod being telescopically inserted into an elbowed section of traverse rod, said elbowed section of traverse rod accepting telescopically a straight length of traverse rod with a right side end fixture inserted into the rod support socket located farthest from the wall on the extender arm of a second end bracket comprising a plurality of rod support sockets corresponding to the rod support sockets of the first end bracket; a curtain rod assembly having a straight length of curtain rod affixed in the rod support socket located in the middle position of said extender arm of said first end bracket, the free end of said straight length of curtain rod being telescopically inserted into an elbowed section of curtain rod, said elbowed section of curtain rod accepting telescopically a straight length of curtain rod, the free end of said curtain rod being telescopically inserted into an elbowed section of curtain rod, said elbowed section of curtain rod accepting telescopically at its free end a straight length of curtain rod, the free end of said curtain rod being affixed in the rod support socket located in the middle position of said extender arm of said second end bracket; a second curtain rod assembly having a straight length of curtain rod affixed in the rod support socket located closest to the wall of said extender arm of said first end bracket, the free end of said curtain rod being telescopically inserted into an elbowed section of curtain rod, said elbowed section of curtain rod accepting telescopically at its free end a straight length of curtain rod, the free end of said straight section of curtain rod being telescopically inserted into an elbowed section of curtain rod, said elbowed section of curtain rod accepting telescopically at its free end a straight length of curtain rod, the free end of said straight length of curtain rod being affixed in the curtain rod support socket located closest to the wall of said extender arm of said second end bracket; a valance rod assembly having a length of valance rod curved at its left end and slidably engaged with the valance rod support segment of said first end bracket, curving around the end of said mated two-piece rod support segment of said first end bracket in spaced relation thereto, the free end of said curved valance rod being inserted telescopically into an elbowed section of valance rod, said elbowed section of valance rod accepting telescopically at its free end a straight length of valance rod, the free end of said straight length of valance rod being telescopically inserted into an elbowed section of valance rod, said elbowed section of valance rod accepting telescopically at its free end a length of valance rod curved at its free end and slidably engaged with the valance rod support segment of said second end bracket, said length of valance rod curving around the end of said mated, two-piece rod support segment of said second end bracket in spaced relation thereto; a plurality of two-piece slidably mated auxiliary support brackets each having a wall mounted segment and a mating rod support segment having a plurality of rod support stirrups located on a bottom side thereof to engage and support each of the traverse and curtain rods and a rod support stirrup located on a top side thereof to engage and support the valence rod, whereby the combined assembly of traverse, curtain, and valance rods and the related mating segments of said first and second end brackets and said auxiliary support brackets can be mounted on the wall mounted segments of said end brackets and said auxiliary support brackets as an unitary assembly.

* * * * *